US008182175B2

(12) United States Patent
Iffergan

(10) Patent No.: US 8,182,175 B2
(45) Date of Patent: May 22, 2012

(54) GATE FOR MARINE OPTIC FIBER SECURITY FENCE

(76) Inventor: David Iffergan, Sugarland, TX (US)

( * ) Notice: Subject to any disclaimer, the term of this patent is extended or adjusted under 35 U.S.C. 154(b) by 280 days.

(21) Appl. No.: 12/727,474

(22) Filed: Mar. 19, 2010

(65) Prior Publication Data

US 2011/0227016 A1 Sep. 22, 2011

(51) Int. Cl.
*E02B 3/04* (2006.01)

(52) U.S. Cl. ..... 405/64; 405/104; 405/195.1

(58) Field of Classification Search ..... 405/63, 405/64, 87, 103, 104, 195.1, 211
See application file for complete search history.

(56) References Cited

U.S. PATENT DOCUMENTS

| | | | | |
|---|---|---|---|---|
| 2,391,059 | A * | 12/1945 | MacFarren | 405/52 |
| 3,187,793 | A * | 6/1965 | Quase | 405/210 |
| 3,984,987 | A * | 10/1976 | Light, Jr. | 405/63 |
| 4,146,346 | A * | 3/1979 | Salo | 405/87 |
| 4,300,857 | A * | 11/1981 | Santamaria | 405/70 |
| 4,365,239 | A | 12/1982 | Mongeon | |
| 4,371,869 | A | 2/1983 | Davidson | |
| 4,399,430 | A | 8/1983 | Kitchen | |
| 4,450,434 | A | 5/1984 | Nielsen et al. | |
| 4,484,836 | A * | 11/1984 | Bailard | 405/64 |
| 4,558,308 | A | 12/1985 | Ciordinik et al. | |
| 4,688,024 | A | 8/1987 | Gadde | |
| 4,738,563 | A | 4/1988 | Clark | |
| 4,815,815 | A * | 3/1989 | Mori | 362/1 |
| 4,829,286 | A | 5/1989 | Zvi | |
| 5,154,537 | A * | 10/1992 | DeVries et al. | 405/63 |
| 5,530,430 | A | 6/1996 | Pavlov | |
| 6,681,709 | B1 | 1/2004 | Nixon et al. | |
| 6,843,197 | B1 | 1/2005 | Nixon et al. | |
| 6,980,108 | B1 | 12/2005 | Gebbia et al. | |
| H2148 | H | 3/2006 | Mastro et al. | |
| 7,068,166 | B2 | 6/2006 | Shibata et al. | |
| 7,110,625 | B2 | 9/2006 | Chun | |
| 7,123,785 | B2 | 10/2006 | Iffergan | |

(Continued)

FOREIGN PATENT DOCUMENTS

GB 2 038 060 7/1980

(Continued)

OTHER PUBLICATIONS

Search and Examination Report in corresponding application GB 1104659.6, Jul. 15, 2011.

(Continued)

*Primary Examiner* — Frederick L Lagman
(74) *Attorney, Agent, or Firm* — Thomas & Karceski, PC

(57) ABSTRACT

A marine gate includes a gate member submersible in a body of water. At least a first post and a second post support the gate member. The gate member is slidably secured on the first and second posts so that the gate member is movable between first and second locations above and below the waterline. The marine gate includes a winch, a cable extending from the winch to the gate member, and an optic fiber net attached at least to the gate member and extending to the sea floor, thereby establishing an underwater fence. Operation of the winch alters a length of the cable, thereby permitting the gate member to be raised to a closed position and to be lowered to an opened position such that a vessel may pass through the gate when the gate member is in the opened position.

17 Claims, 12 Drawing Sheets

U.S. PATENT DOCUMENTS

| | | | | |
|---|---|---|---|---|
| 7,134,807 | B2 * | 11/2006 | Dreyer | 405/64 |
| 7,135,970 | B2 | 11/2006 | Kowal et al. | |
| 7,140,599 | B1 | 11/2006 | Spink | |
| 7,173,690 | B2 | 2/2007 | Haran | |
| 7,184,907 | B2 | 2/2007 | Chun | |
| 7,233,544 | B1 | 6/2007 | McDonald | |
| 7,245,810 | B2 | 7/2007 | Iffergan | |
| 7,339,474 | B2 | 3/2008 | Easley et al. | |
| 7,385,506 | B2 | 6/2008 | Shibata et al. | |
| 7,402,790 | B2 | 7/2008 | Browning, Jr. et al. | |
| 7,419,140 | B2 | 9/2008 | Perry | |
| 7,488,929 | B2 | 2/2009 | Townley-Smith et al. | |
| 7,590,322 | B2 | 9/2009 | Puzan et al. | |
| 7,637,224 | B1 | 12/2009 | Portmann et al. | |
| 2005/0225277 | A1 | 10/2005 | Savard et al. | |
| 2006/0083458 | A1 | 4/2006 | Iffergan | |
| 2006/0216116 | A1 * | 9/2006 | Baker et al. | 405/63 |
| 2008/0298899 | A1 * | 12/2008 | Glessner et al. | 405/218 |
| 2009/0035068 | A1 | 2/2009 | Terai et al. | |
| 2011/0227731 | A1 * | 9/2011 | Iffergan | 340/541 |
| 2011/0227753 | A1 * | 9/2011 | Iffergan | 340/850 |

FOREIGN PATENT DOCUMENTS

| | | | |
|---|---|---|---|
| GB | 2052092 | A | 1/1981 |
| GB | 2258553 | A | 2/1993 |
| JP | 3-053400 | | 3/1991 |
| NL | 1021754 | C2 | 4/2004 |

OTHER PUBLICATIONS

Search and Examination Report in corresponding application GB 1104660.4 Apr. 20, 2011.

* cited by examiner

GATE FOR MARINE OPTIC FIBER SECURITY FENCE

CROSS-REFERENCE TO RELATED PATENT APPLICATION(S)

The present patent application is a first-filed patent application and does not rely for priority on any other patent application.

FIELD OF THE INVENTION

The present invention is directed to a gate for an optic fiber security fence that may be employed in a marine environment. More specifically, the present invention concerns a gate that may be opened and closed to permit ships and vessels to enter into a secure area defined by a security fence that extends both above and below the surface of a body of water.

BACKGROUND OF THE INVENTION

Security of physical localities has always been, and continues to be, a matter of concern for various entities, governmental and private alike.

While there are numerous systems and apparatuses that have been developed to secure land-based installations, systems and apparatuses that may be employed or deployed in marine (i.e., water) environments are less prevalent, primarily due to the difficulties associated with the placement and maintenance of such systems in marine environments.

As detailed below, many marine security apparatuses and systems employ sonar (or equivalent detection systems) to determine if an intruder is approaching or has entered a secure marine perimeter.

While sonar is effective in detecting the approach or entry of intruders into a secure marine perimeter, there are limitations to sonar. Specifically, with respect to small -sized intruders, sonar has detection limitations. This may become a concern if the intruder is a diver or some type of robotic submersible.

There has developed, therefore, a desire for those seeking to secure a marine perimeter for systems that provide reliable intruder detection. In particular, there has developed a desire for perimeter barriers that provide a physical barrier while also providing a capability for automated detection of intrusions and attempted intrusions.

When providing a marine perimeter security system, it becomes necessary to provide a system that permits vessels and ships to enter into and exit from the secure marine location. Accordingly, there has also developed a desire to secure and marine perimeter and also to provide ingress into and egress from the secured perimeter.

Before providing a summary of the present invention, a summary of some prior art devices is provided below.

U.S. Statutory Invention Registration No. H 2148 describes an underwater net protection system. The system includes a flexible netting 14, extending upwardly from underwater anchor locations 16, that defines an underwater protective zone 10. Penetration attempts, such as a hole 20 in the flexible netting 14, are monitored by a system 18. The bottom portion 19 of the netting 14 is made from a substantially heavier material than the rest of the netting 14 so as to resist or prevent lifting thereof. The netting is made from elongated netting elements 26 that are cross-fastened to one another. The elongated netting elements 26 include a tubular portion 28 that encases the optical fiber signal line 30 and a reinforcement member 29 that extends in parallel with the optic fiber signal line 30. An attempt to cut (or an actual cut through) the netting 14 is detected by the penetration detection system 18. As illustrated in FIG. 1, it appears that the netting 14 is suspended from a ship to protect a dock 12.

U.S. Pat. No. 7,233,544 describes a harbor fence that is used to establish a security perimeter around a ship or other vessel, for example. The harbor fence system 103 includes a number of spars 105, 107, 109 that are connected to one another at the waterline by a cable containing multiple wires and at the top by a thinner top line with at least one wire. The shape of the harbor fence 103 is maintained by moors 111, which includes a floating platform 151 that is anchored by anchors 153, 155. The spar 109 includes an upper section 161, a retractable keel 163, and a counterweight 165. The upper section 161 may include sensors to detect whether the harbor fence 103 is being impacted. The system may also detect a cut in the top line. Alternatively, the harbor fence system 103 may interact with an underwater sonar system 1300 that can detect underwater intruders that attempt to dive beneath the harbor fence system 103.

U.S. Pat. No. 6,681,709 describes a port security barrier system 10 that is designed to stop hostile, high speed, waterborne craft 12 that attempt to enter the area secured by the barrier system 10. The security barrier 10 is made up of several modules 14, each of which is about 50 feet (15.24 m) in length. A mooring system 15 includes mooring buoys 16, mooring lines 18, and mooring anchors 20. When assembled, the barrier 10 provides a continuous, floating wall for the port facility that extends from 1 to 8 feet (30.48 to 243.84 cm) above the water. The barrier system 10 appears to be designed specifically for threats on the water's surface.

U.S. Pat. No. 7,140,599 describes a coupling system and method for marine barriers. Specifically, this patent describes a barrier system that includes a coupler that permits adjacent sections of the barrier system to be stored (in a non-deployed state) in a side-by-side fashion. With respect to FIG. 31, for example, the system includes barrier segments 880 with float pipes 882, net posts 884, and a net system 886. The barrier system 880 also includes a raft module 890 such that a predetermined load may be supported on the platform 894. The barrier system 880 creates a barrier line to prevent ingress of watercraft into a protected zone surrounded by the barrier system 880. The barrier system 880 appears to be directed to threats on the surface of a body of water.

U.S. Pat. No. 7,123,785 is directed to an optic fiber security fence system that includes an optical fiber net woven from an optical fiber wire. A light generator introduces an incident light signal into the optical fiber wire. A light receiver receives an exigent light signal from the optical fiber wire. An optical sensor wire also is provided. The optical sensor wire is connected to the optical fiber wire and is displaced when a force is applied to the optical fiber net. The optical sensor wire receives a patterned incident light signal that is altered upon application of a force to the optical fiber net, thereby producing an altered patterned exigent light signal. The light receiver initiates an alarm either (1) if the exigent light signal from the optical fiber wire terminates, or (2) after comparing the exigent patterned light signal with the incident patterned light signal in the optical sensor wire and establishing a deviation, if the deviation exceeds a predetermined threshold.

U.S. Pat. No. 7,245,810 describes a fiber optic cable fastener that joins fiber optic cable. The fastener includes a first segment having a plurality of grooves to accommodate portions of the fiber optic cables. Raised contoured portions are configured to damage the fiber optic cables if an intruder tampers with the fastener.

U.S. Pat. No. 4,399,430 describes an intruder detection security system including a security fence 2 made from a plurality of elongated members 4, 6, 8, 10, 12, and 14. The elongated members are optical fibers surrounded by or coated with polyvinyl chloride ("PVC"). FIG. 9 of the '430 patent illustrates the cross-section of one of the elongated members, showing the optical fiber 1 loosely housed within a PVC tube 5 reinforced with Kevlar® strength members 3. (Kevlar® is a trademark of the Dupont Company referring to a para-aramid fiber manufactured by that company. According to the information provided by the DuPont Company through its website, http://www.dupont.com/kevlar/whatiskevlar.html, Kevlar® fibers consist of long molecular chains produced from poly-paraphenylene terephthalamide.) The elongated members 4, 6, 8, 10, 12, 14 form a mesh between two upright posts 16, 18. In one embodiment, at each joining point 20 of the elongated members 8, 10, 12, 14, the elongated members 8, 10, 12, 14 are joined together by a steel ferrule 36. The optical fibers 4, 6, 8, 10, 12, 14 are connected between an output control box 22 and an input control box 24. If the amplitude of the signals received by the output control box 22 fall outside a predetermined range, an output signal is transmitted to operate an alarm 34.

U.S. Pat. No. 4,371,869 describes a fence or wall incorporating a fiber-optic wave guide. The security system described in the '869 patent includes a composite strip 1 of bendable material, which is referred to as a carrier strip 2. The carrier strip 2 may be made of steel, for example. A single fiber-optic filament 3 extends within a groove running along the face of the carrier strip 2. The carrier strip 2 preferably is coated with a corrosion-resistant layer in the form of a sheathing 4, for example. A light source or laser generator 6 directs light into one end of the fiber-optic filament 3 and a detector 7 receives the light signal at the other end. The detector 7 is connected to a warning device 8. The warning device 8 is activated if a change in the intensity of light exiting the fiber-optic filament 3 falls outside of a predetermined range.

U.S. Pat. No. 4,450,434 describes an apparatus for determining a break in locations in fencing. As described, a cable 4 is strung along a fence 2 and is attached to the fence 2 via support means 6 (or is attached to the fence by being interwoven therein). The cable 4 is made of an optical fiber with an electrical transmission line running therealong. In the embodiment illustrated in FIG. 2, the cable 4 is made of two optical fibers 8, 10, which are coated with metalized coatings 12, 14. The coated fibers are separated from one another by the insulating material 16 in which they are embedded. The cable 4 is connected to an LED or laser transmitter 30 at one end and a light receiver 32 at the other end. One end of the transmission line is connected to a pulse generator 34 and a pulse receiver 36. The other end is open-circuited. The optical portion of the cable 4 carries the light signal such that a break in the light signal is detected by the level detector 40, triggering operation of an alarm means 42. The output of the level detector 40 is connected to the input of the electrical pulse generator 34, which generates an electrical pulse that is reflected to the pulse receiver 36. The time delay between the initiation and receipt of the electrical pulse permits the system to establish the location of the break.

U.S. Pat. No. 4,558,308 describes an intrusion warning wire-lattice that comprises a number of single fence sections 1 mounted between box-type posts 2. Each fence section 1 includes solid wires (shown in dashed lines) and a serpentine coil 4 made of a hollow wire (shown in solid lines). The tubular wires encapsulate an electrical or optical conductor 8 that is connected to an alarm system, which is responsive to a break or deformation of the electrical or optical conductor 8.

U.S. Pat. No. 4,829,286 describes a security fence system made up of a taut wire fence made of taut wires 10 strung in a parallel orientation between an anchoring post 12 and a sensor post 14. An optical fiber 17 is threaded serially through a plurality of adjacent sensor posts and is coupled to a signal transceiver 18. A taut wire connection element 34 is connected to the sensor post 14 and to two adjacent taut wires 36. The connection element 34 rotatably connects to the sensor post 14. An optical fiber engagement member 38 connects to the rod 30 so that is also rotates on the sensor post 14. The taut wire connection element 34 and the optical fiber engagement member 38 are connected to one another such that, if the taut wire connection element 34 and the optical fiber engagement member 38 rotate with respect to one another over a long period of time, the optical fiber 42 is not disturbed. As a result, no alarm sounds. However, if the taut wire connection element 34 is rotated rapidly, the optical fiber engagement member 38 also rotates, displacing the optical fiber 42, thereby triggering an alarm.

U.S. Pat. No. 5,530,430 describes a vibration responsive barbed tape security system. The security system is made up of multiple sections of fence barrier 1 that surround an area. The barrier includes a chain link fence 2 and a secondary barrier 4 in the form of a spiral barbed tape. A tube 24 is in contact with each loop of the spiral barbed tape. The tube 24 contains a vibration sensitive fiber optic cable 30 that transmits light in a predictable manner. Any movement or vibration of the tube vibrates the fiber optic cable, triggering an alarm.

UK Patent Application No. GB 2 038 060 describes an intruder alarm that gives an alarm when an intrusion has occurred into a protected area and also gives an alarm when an attempt to breach a protected area is in progress. The intruder alarm includes a network of optical fiber light conductors forming or included in a fence. Light is fed into the ones of the light conductors such that penetration or attempted penetration of the light conductors triggers an alarm.

According to the English translation, Japanese Patent No. JP 3053400 describes a trespasser monitor method that detects whether a trespasser exists and the position of the trespasser by detecting the position of the reflection of an optical pulse from a disconnection point.

Other fence systems that employ an optic fiber sensor include, but are not limited to, U.S. Pat. Nos. 7,488,929, 7,419,140, 7,402,790, 7,385,506, 7,184,907, 7,173,690, 7,135,970, 7,110,625, 7,068,166, and 6,980,108. These fence systems appear to involve only land-based secure perimeters.

U.S. Pat. No. 4,365,239 describes an intrusion warning system for protecting a wall or a fence, in particular a chain link fence, against intrusion (via cutting) or by climbing over same. The system combines a shielded cable 2 with a chain link fence 1. The fence 1 is intended to extend around the perimeter of an area to be protected. The length of the shielded cable 2 may be as long as 1,000 feet (304.8 m) in the described example. The shielded cable 2 is an electrical coaxial cable with an inner conductor surrounded by an outer, shielded conductor with a layer of insulating dielectric material therebetween. In operation, a signal is sent through the coaxial cable. An attempt to break through the fence disrupts the electrical signal, triggering an alarm.

Reference also is made to U.S. Pat. No. 7,339,474, which describes a deflection sensing system that relies on taught, electrified, metal wires to detect an instruction or attempted intrusion.

Concerning optical fibers, reference is made to U.S. Pat. No. 7,590,322, which describes a fiber optic cable with enhanced saltwater performance. The fiber optic cable 100 has a configuration tailored or optimized to inhibit water penetration and water migration down the cable 100. The cable 100 includes water-swellable tape 135 and water-swellable yarn 120 to block migration of fresh water and/or saltwater along the cable 100. The cable includes a jacket 115, a buffer tube 150, and corrugated metal armor 175. Optical fibers 105 are positioned within the water-swellable yarn 120.

As made apparent by the above-identified prior art, physical security systems for marine environments that provide automated intrusion detection are not prevalent in the prior art.

In addition, marine gates that permit ingress into and egress from secure marine perimeters also are not prevalent in the prior art.

SUMMARY OF THE INVENTION

The present invention provides a gate for a physical, security barrier system that includes automated detection of intrusions and/or attempted intrusions with respect to a secure marine perimeter.

Specifically, the present invention provides for a gate that permits ingress into and egress from a secure marine perimeter that is protected by an optical fence.

It is one contemplated aspect of the present invention to provide an apparatus that permits an optical fiber security fence to be opened and closed without deactivation of the optic fiber security fence that defines a secure marine perimeter.

To permit vessels to enter into and exit from the secure marine perimeter, the present invention provides a marine gate. The marine gate includes a gate member submersible in a body of water, wherein the body of water is defined by a sea floor and a waterline. The gate also includes a first post and a second post supporting the gate member. The first and second posts extend from a first location at the sea floor to a second location above the waterline. The gate member is slidably secured on the first and second posts so that the gate member is movable between the first and second locations. The gate also includes a winch, a cable extending from the winch to the gate member, and an optic fiber net attached at least to the gate member and extending to the sea floor, thereby establishing an underwater fence. Operation of the winch alters a length of the cable, thereby permitting the gate member to be raised to a closed position and to be lowered to an opened position such that a vessel may pass through the gate when the gate member is in the opened position.

In one embodiment of the present invention, the marine gate includes a first pulley disposed at a location adjacent to a top of the first post, a second pulley disposed on the gate member adjacent to the first post, and a third pulley disposed on the gate member adjacent to the second post. The cable extends from the winch, from the first pulley to the second pulley, from the second pulley to the third pulley, and from the third pulley to a fixed location on the second post.

In another embodiment of the present invention, the first post and the second post each include two cylindrical pipes disposed adjacent to one another.

The present invention also provide a marine gate where the gate member includes a plurality of rollers in contact with the first and second posts to facilitate slidable engagement between the gate member and the first and second posts.

In the present invention, the optic fiber net includes at least one optic fiber wire woven to form a continuous light channel from a first end to a second end.

In another contemplated embodiment of the present invention, The marine gate includes a light generator connected to the first end of the optic fiber net to introduce a light signal thereinto, a light receiver connected to the second end to receive a light signal exigent from the optic fiber net, and a monitoring station connected at least to the light receiver.

In still another embodiment of the present invention, the monitoring station generates an alarm if the light signal received by the light receiver differs from the light signal introduced into the first end by a predetermined amount.

In a further embodiment, the marine gate of the present invention includes a hollow bottom portion through which the cable travels from the second pulley to the third pulley.

The present invention also provides for a marine gate where the gate member includes two tubular members extending upwardly from the hollow bottom portion, wherein the cable travels through the one of the two tubular members from the first pulley to the second pulley and through the second of the two tubular members from the third pulley to the fixed location on the second post.

In an embodiment of the present invention, the marine gate includes a first base structure, and a second base structure. The first and second base structures are disposed on the sea floor and define channels therein to receive the first post and the second post, respectively.

In still another embodiment of the present invention, the first and second base structures further define conical portions therein to facilitate positioning of the first and second posts therein.

It is contemplated that the winch used to open and close the gate may be electrically powered, powered by a diesel motor, and/or pneumatically operated.

It is also contemplated that the optic fiber net extends from the gate member to the first and second base structures.

In a further embodiment, the first and second base structures define channels therein to receive bottom edge of the optic fiber net.

It is also contemplated that the first and second base structures are at least partially buried in the sea floor.

Further aspects of the invention will become apparent from the discussion that follows.

BRIEF DESCRIPTION OF THE DRAWINGS

The drawings appended hereto are intended to assist in the discussion of the invention and are not intended to be limiting of the invention. Where appropriate, like reference numerals refer to like structures and components, in which.

Other aspects of the present invention should be appreciated from the drawings appended hereto.

DESCRIPTION OF PREFERRED EMBODIMENT(S) OF THE INVENTION

The present invention is for a gate that is intended to operate in conjunction with a fence security system in a marine environment. While specific embodiments of the invention will be described herein, the embodiments are meant to be illustrative only and are not meant to be limiting of the scope of the invention. To the contrary, those skilled in the art will appreciate variations and equivalents of the marine gate described herein. Those variations and equivalents are intended to be encompassed by the present invention, even if not explicitly described herein.

Figure 1:
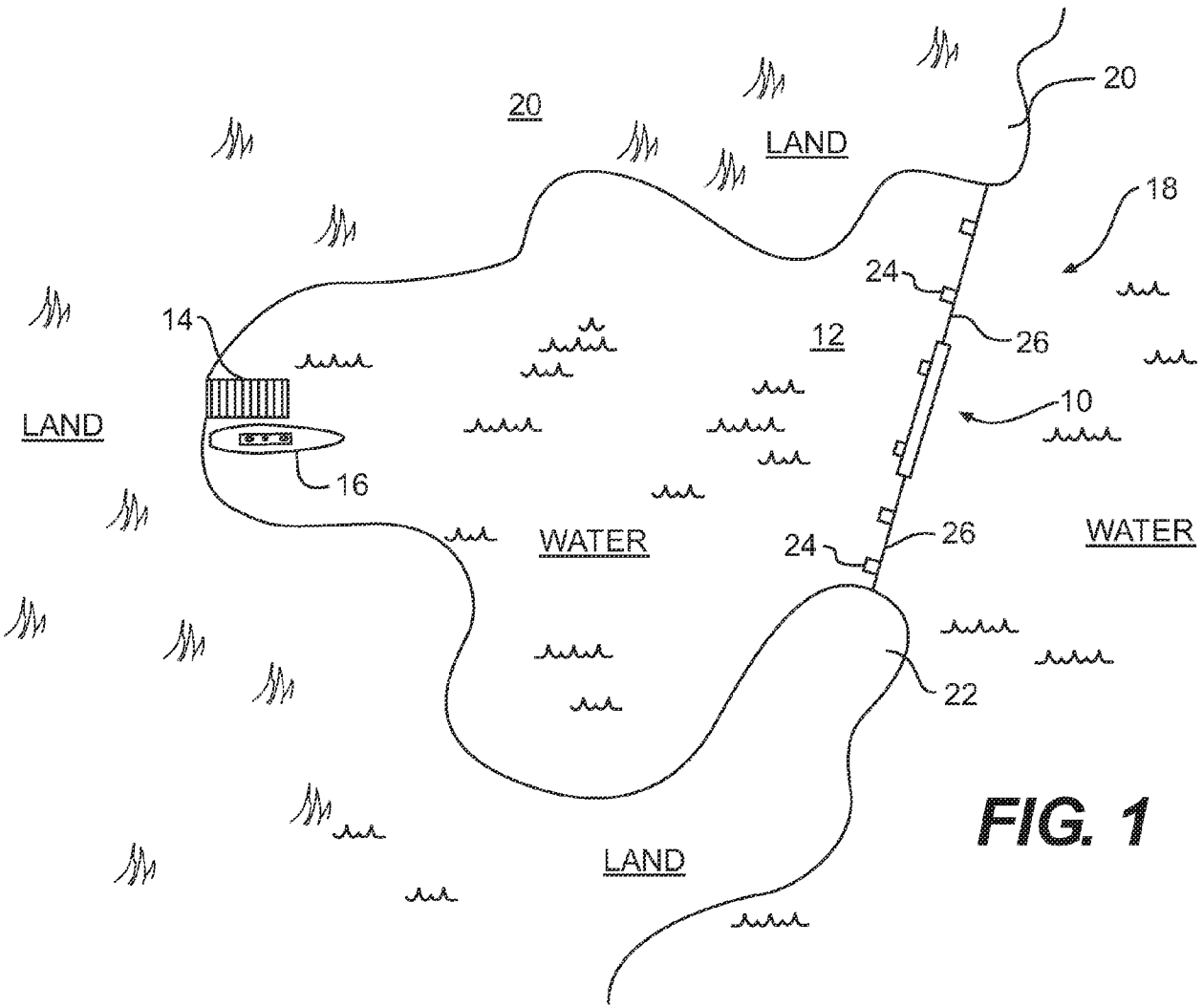
FIG. 1 is top view of one contemplated installation of the gate of the present invention.

FIG. 1 provides an aerial schematic illustration of one contemplated deployment of the marine gate 10 of the present invention. The marine gate 10 is positioned at the mouth of a bay or harbor 12, which includes a dock 14 and a vessel 16 for illustrative purposes. The marine gate 10 is contemplated to form a portion of a fence 18 that extends across the mount of the harbor from a first land position 20 to a second land position 22.

For purposes of the present invention, it is noted that the fence 18 may be of any particular kind. However, it is contemplated that the fence 18 will include one or more uprights 24 and an optic fiber net 26 that, together, establish the security barrier for the harbor 12. While FIG. 1 illustrates uprights 24 to secure the optic fiber net 26 across the mouth of the harbor 12, the optic fiber net 26 may be secured to one or more platforms floating on the surface of the water. Still other variations are contemplated for the fence 18.

While FIG. 1 illustrates the marine gate 10 as a point of ingress into and egress from the harbor 12, it is contemplated that the marine gate 10 of the present invention may be employed in other circumstances. For example, the fence 18 may be deployed around a vessel that is not at dock. The fence 18, therefore, would present a secure location on the surface of a body of water that is unconnected to a land-based feature. The gate 10 may be incorporated into the fence 18 so that a vessel my enter into and exit from the perimeter secured by the fence 18.

The exact details of the fence 18 are not essential to the operation of the present invention. As such, details of the fence 18 are not provided here except as considered appropriate to convey the scope of the present invention.

Figure 2:
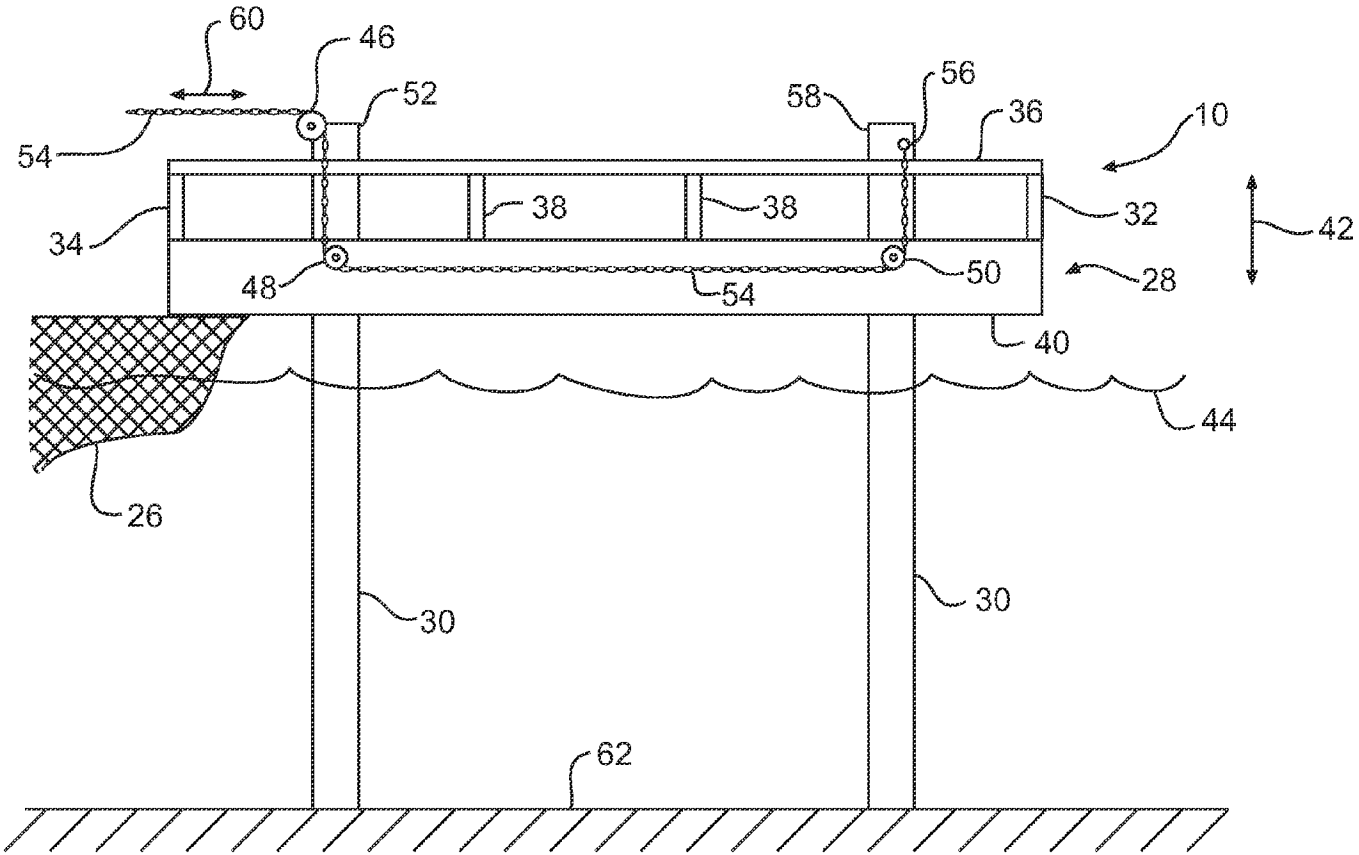
FIG. 2 is a front elevation of the gate of the present invention, showing the gate in the closed position.

FIG. 2 illustrates, in a simplified schematic form, a first embodiment of the marine gate 10 of the present invention. The marine gate 10 includes a rigid gate member 28 that is supported on two rigid posts 30.

The gate member 28 includes a top bar 32, a right side bar 34, a left side bar 36, and two intermediate bars 38. The gate member 12 also includes a bottom portion 40. The top bar 36, side bars 32, 34, intermediate bars 38, and the bottom portion 40 are connected to one another to form a unitary structure. It is contemplated that the gate member 28 and its various components will be made from metal, suitably a metal that resists corrosion. Stainless steel and aluminum are suitable metals for the components of the gate member 28. Of course, as should be appreciated by those skilled in the art, any number of different materials may be selected for the gate member 28. Other materials include, but are not limited to, wood, plastics, concrete, composites, or a combination thereof.

The gate 10 of the present invention is intended to act as part of the security perimeter defined by the fence 18. In some installations, the gate member 28 may present an attractive point of attack to a would-be intruder. For this reason, it is contemplated that the gate member 28 and the rigid posts 30 will be sufficiently strong and robust to withstand at least some minimal impact from an object, such as a boat, for example. While the gate member 28 is contemplated to be made from strong and rigid material, weight may become a significant factor, especially where the gate member 28 is designed to extend across a large opening in the fence 28. As a result, lower weight materials may be preferred for construction of the gate member 28.

The gate member 28 is contemplated to be moveably attached to the rigid posts 30. Specifically, the gate member 28 is connected to the rigid posts so that the gate member 28 may move in a vertical direction with respect thereto. The arrow 42 is provided, in FIG. 1 to indicate the direction of movement of the gate member 28.

As noted above, the fence 18 is anticipated to include an optic fiber net 26. A portion of the optic fiber net 26 is illustrated in FIG. 2. As better illustrated in FIGS. 4 and 5, for example, the optic fiber net 26 is affixed to the bottom portion 40 of the gate member 28. It is noted that the optic fiber net 26 may be affixed to any portion of the gate member 28 and need not be affixed to the bottom portion 40, as illustrated. The particular arrangement illustrated in FIG. 2 is merely one arrangement contemplated by the present invention.

FIG. 2 illustrates the gate member 28 in the closed position, meaning that the gate member 28 has been moved to the upper ends of the rigid posts 30. In this position, the gate member 28 is disposed above the waterline 44. As a result, if a vessel 16 were to approach the gate member 28 with the intention of breaking into the secure area, the gate member 28 will prevent the vessel 16 from its unauthorized entry.

Figure 3:
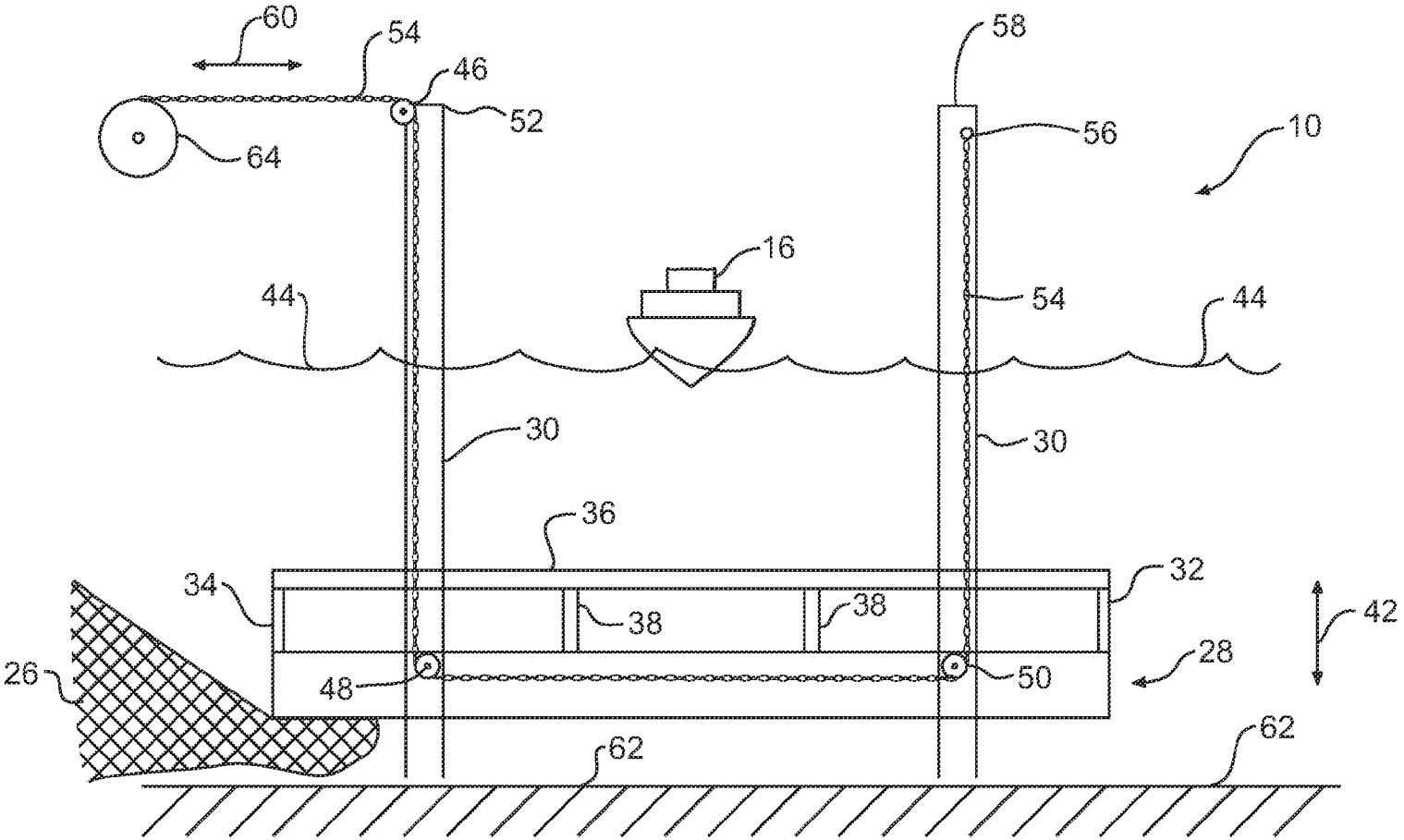
FIG. 3 is a front elevation of the gate shown in FIG. 1, with the gate moved to the opened: position.

FIG. 3 illustrates the gate member 28 in its lowered position. As a result, in this illustration, the marine gate 10 is open, thereby permitting the passage of vessels 16 into and out of the secure perimeter.

The operation of the marine gate 10 will now be described in connection with FIGS. 2 and 3.

As illustrated in FIGS. 2 and 3, the marine gate includes a first pulley 46, a second pulley 48, and a third pulley 50. The first pulley 46 is rotatably affixed at or near the top end 52 of one of the rigid posts 30. The second pulley is rotatably attached at the left side of the bottom portion 40 of the gate member 28. The third pulley 50 is rotatably attached at the right side of the bottom portion 40 of the gate member 28. A wire or cable 54 extends over the first, second, and third pulleys 46, 48, 50 and is connected to a fixed location, such as an eyelet or a pin 56, at or near the top 58 of a second one of the rigid posts 30.

The cable 54 is contemplated to be connected to a winch 64 or similar device where the cable 54 may be wound onto a suitable drum or other structure. Additionally, the cable 54 is contemplated to be a cable or a wire made from stainless steel. Stainless steel is anticipated to provide better corrosion resistance than other materials in the marine environment. Of course, other materials may be used without departing from the scope of the present invention. For example, a rope may be used.

The winch 64 is contemplated to be an electric winch, a diesel powered winch, or a pneumatically-powered winch. In one contemplated embodiment, the winch 64 is an electric winch with a diesel-powered back-up system for operation.

In another contemplated embodiment, the winch 64 is pneumatically operated. If pneumatically operated, it is contemplated that the pneumatic operating system will include a pneumatic reservoir that will retain a sufficient pneumatic charge to operate the gate 66 for a predetermined period of time, should the system lose operation of the pneumatic generator. For example, the system may include a reservoir to operate the gate 66 for a period of two days upon the loss of the pneumatic generator. In a pneumatic system, the generator would be set to operate when pressure in the pneumatic reservoir reaches a predetermined threshold amount.

Regardless of the type of system contemplated for the gate of the present invention, it is also contemplated that the gate will include one or more manual or semi-manual systems so that the gate 66 may be operated in the absence of power. For a small gate, it is contemplated that a hand crank may suffice as a suitable back-up system.

As may be appreciated from FIGS. 2 and 3, when the cable 54 is unwound from the winch 64, the cable moves in the direction of the arrow 60. Since the end of the cable 54 is affixed to the pin 56 on the rigid post 30, when the cable 54 is unwound, the weight of the gate member 28 pulls the gate member 28 is into the water, toward the sea floor 62. As the gate member 28 travels further into the water below the waterline 44, an opening is created so that a vessel 16 may pass through the marine gate 10.

As may be appreciated from FIG. 3, the optic fiber net 26 is flexible and behaves like a curtain draped from the gate member 28. As the gate member 28 is lowered, the optic fiber net 26 is lowered with the gate member 28.

Figure 11:
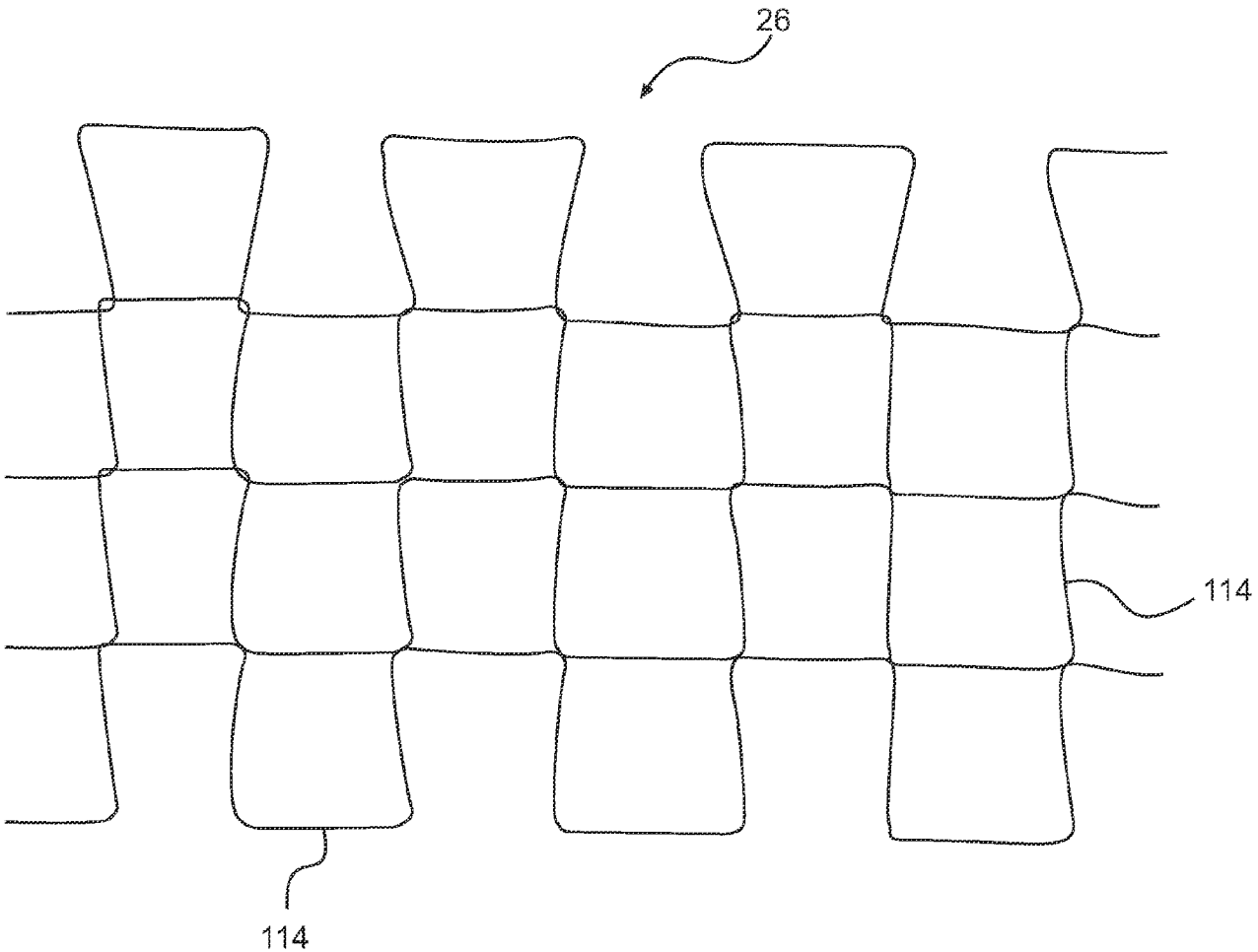
FIG. 11 is a schematic illustration of the optic fiber net that is used in conjunction with the marine gate of the present invention.
Figure 12:
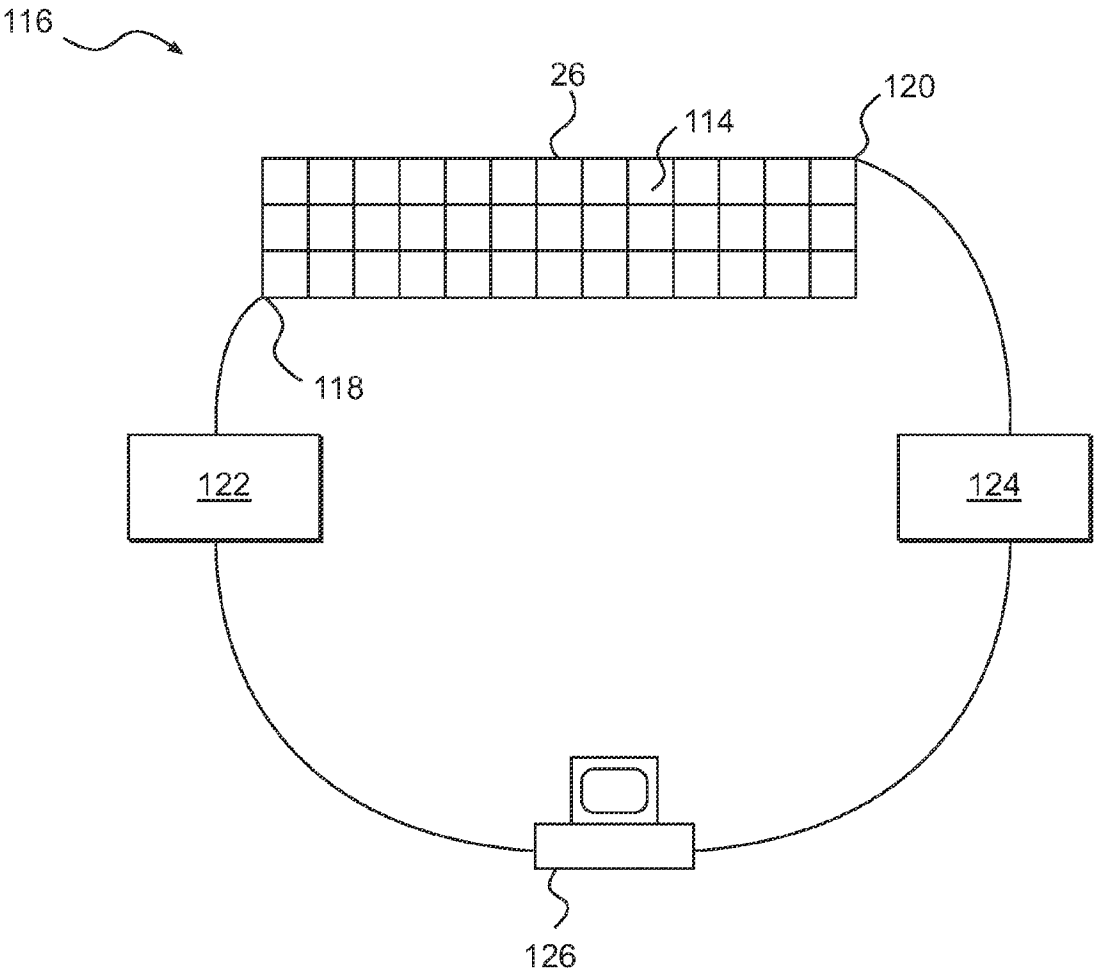
FIG. 12 is a schematic illustration of one possible arrangement of components that may be employed to monitor the optic fiber net for breaches in the net.

Details of the optic fiber net 26 are provided in connection with FIGS. 11-12. It is noted that a specific construction for the optic fiber net is not required to practice the present invention.

While the marine gate 10 of the present invention is intended to cooperate with an optic fiber net 26, it is noted that the marine gate 10 may be used in cooperation with other fence systems that do not incorporate fiber optic technology.

Figure 4:
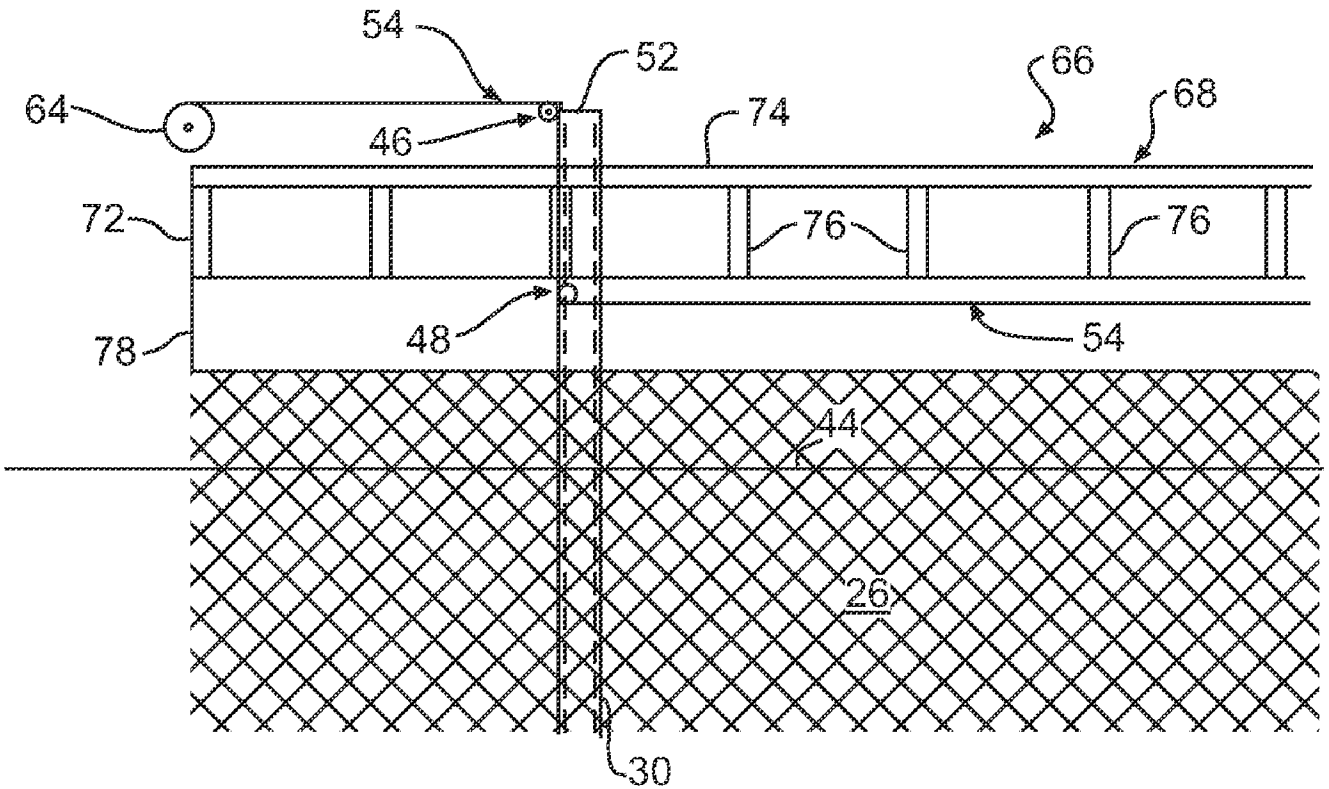
FIG. 4 is a plan view of the left-hand side of the gate of the present invention, including the optic fiber net security barrier.
Figure 5:
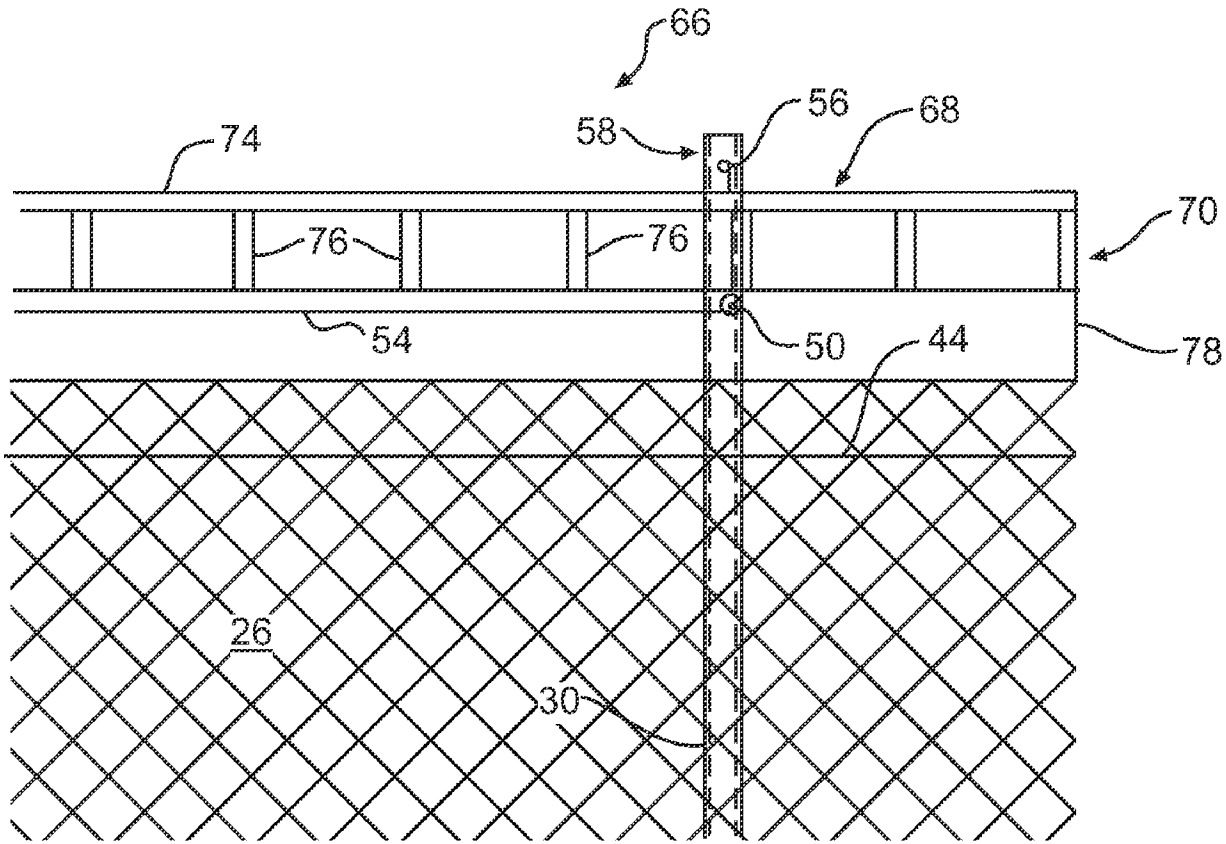
FIG. 5 is a plan view of the right-hand side of the gate shown in FIG. 4.

FIGS. 4 and 5 illustrate another embodiment of the marine gate 66 according to the present invention. Here, the marine gate 66 differs from the prior embodiment in the construction of the gate member 66, among other features. As may be apparent from the drawings, FIG. 4 illustrates the left hand side of the marine gate 66 while FIG. 5 illustrates the right hand side of the marine gate 66.

In FIGS. 4-5, the marine gate 66 includes a gate member 68 that is similar to the gate member 28. The gate member 68 includes a right side bar 70, a left side bar 72, a top bar 74, intermediate bars 76, and a bottom portion 78. As with the marine gate 10, the marine gate 66 includes two rigid guide posts 30. An optic fiber net 26 is affixed to the bottom portion 78. A cable 54 extends over first, second, and third pulleys 46, 48, 50 and is affixed to a pin 56.

This embodiment of the marine gate 66 differs from the marine gate 10 in that the bottom portion 68 is intended to enclose the cable 54 so that the cable 54 is not visible. The enclosed bottom portion 68, therefore, protects the cable 54 by discouraging a would-be intruder from cutting the cable 54 and, thereby, causing the marine gate 66 to open. In this embodiment, it is contemplated that the right side bar 70, the left side bar 72. The top bar 74, and the intermediate bars 76 will be constructed from steel tubes with cross-sectional dimensions of 4 inches by 12 inches (10.16 cm×30.48 cm). The bottom portion 68 may be constructed from a steel tube with a cross-sectional size of 20 inches by 12 inches (50.8 cm×30.48 cm). As should be appreciated, steel need not be used. Moreover, the dimensions are provided merely as one contemplated example of the dimensions contemplated for the marine gate 66 of the present invention.

FIGS. 6-10 provide additional details with respect to the marine gate 66 of the present invention.

Figure 6:
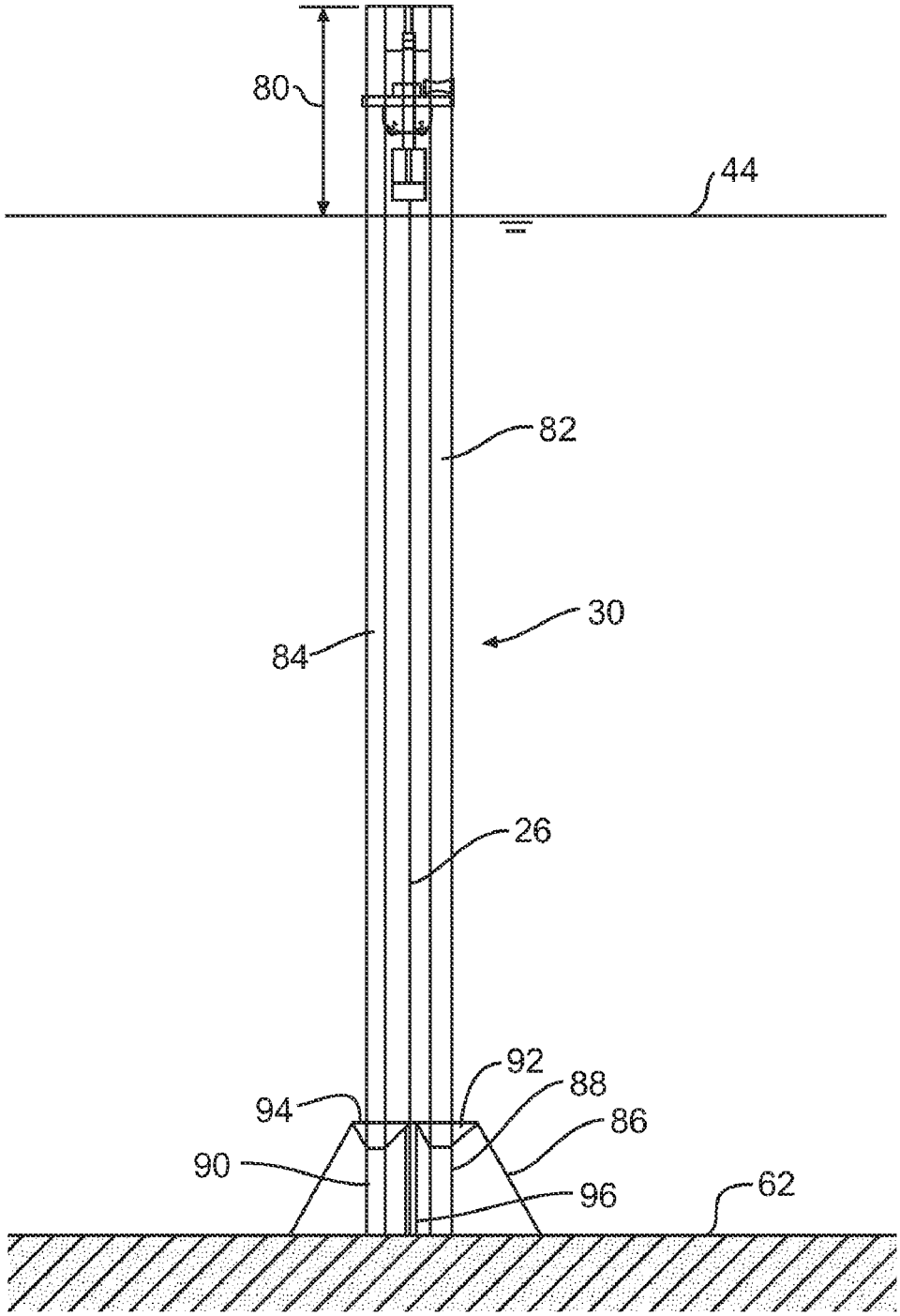
FIG. 6 is a side view illustration of one embodiment of the gate of the present invention.

FIG. 6 is a side view illustration of the marine gate 66 of the present invention, showing the details of one of the guide posts 30. As illustrated, the guide post 30 extends from the sea floor 62 to a predetermined height 80 above the waterline 44. While the predetermined height 80 may be any suitable distance determined by the particular body of water in which the marine gate 66 is positioned. In bodies of water where the tides present a large variation over the course of a day, the height 80 is contemplated to be greater than circumstances where the tidal changes are more moderate. It is contemplated that the height 80 will be between about 1.0 and 3.0 meters, as an example.

The guide post 30 includes a first post 82 and a second post 84 disposed adjacent to one another. The first post 82 and the second post 84 are illustrated as cylindrical pipes. While this construction is preferred because the cylindrical surface cooperates with the rollers incorporated into the gate member 68, posts with other cross-sections may be used without departing from the scope of the present invention.

The guide posts 82, 84 are contemplated to be made from simple steel coated in a protective paint. Of course, the guide posts 82, 84 may be stainless steel, aluminum, or any other material that resists corrosion, without departing from the scope of the present invention. The guide posts 82, 84 do not need to have a protective coating. In addition, the guide posts 82, 84 may be connected to a sacrificial anode to further enhance corrosion resistance.

It is contemplated that the guide posts 82, 84 may be made from piping that is 8 inches (20.32 cm) in diameter. As should be appreciated, this dimension is merely exemplary. Larger or smaller diameter tubes may be employed without departing from the scope of the present invention. For greater impact resistance, for example, a pipe that is 10 inches (25.4 cm) in diameter may offer a more robust option.

The first and second posts 82, 84 are secured in a base structure 86 that is secured in the sea floor 62. Specifically, the first post 82 is secured in a first channel 88 and the second post is disposed in a second channel 90. The top end of the first channel 88 includes a first conical region 92. Similarly, the top end of the second channel 90 includes a second conical region 94. The first and second conical regions 92, 94 assist with placement of the first and second posts 82, 84 therein. While it is anticipated that the weight of the marine gate 66 will be sufficient to secure the posts 82, 84 in the channels 88, 90, the posts 82, 84 may be secured therein using a suitable fastener, including an adhesive or concrete.

With respect to the base structure 86, it is contemplated that the base structure 86 will be made from a material such as concrete. The base structure 86, however, may be constructed entirely from steel plates or other suitable materials without departing from the scope of the present invention. Regardless of the construction, the base structure 86 may include a central channel 96 therein to accommodate the bottom edge 98 of the optic fiber net 26 that is connected to the gate member 68, as discussed above.

Figure 7:
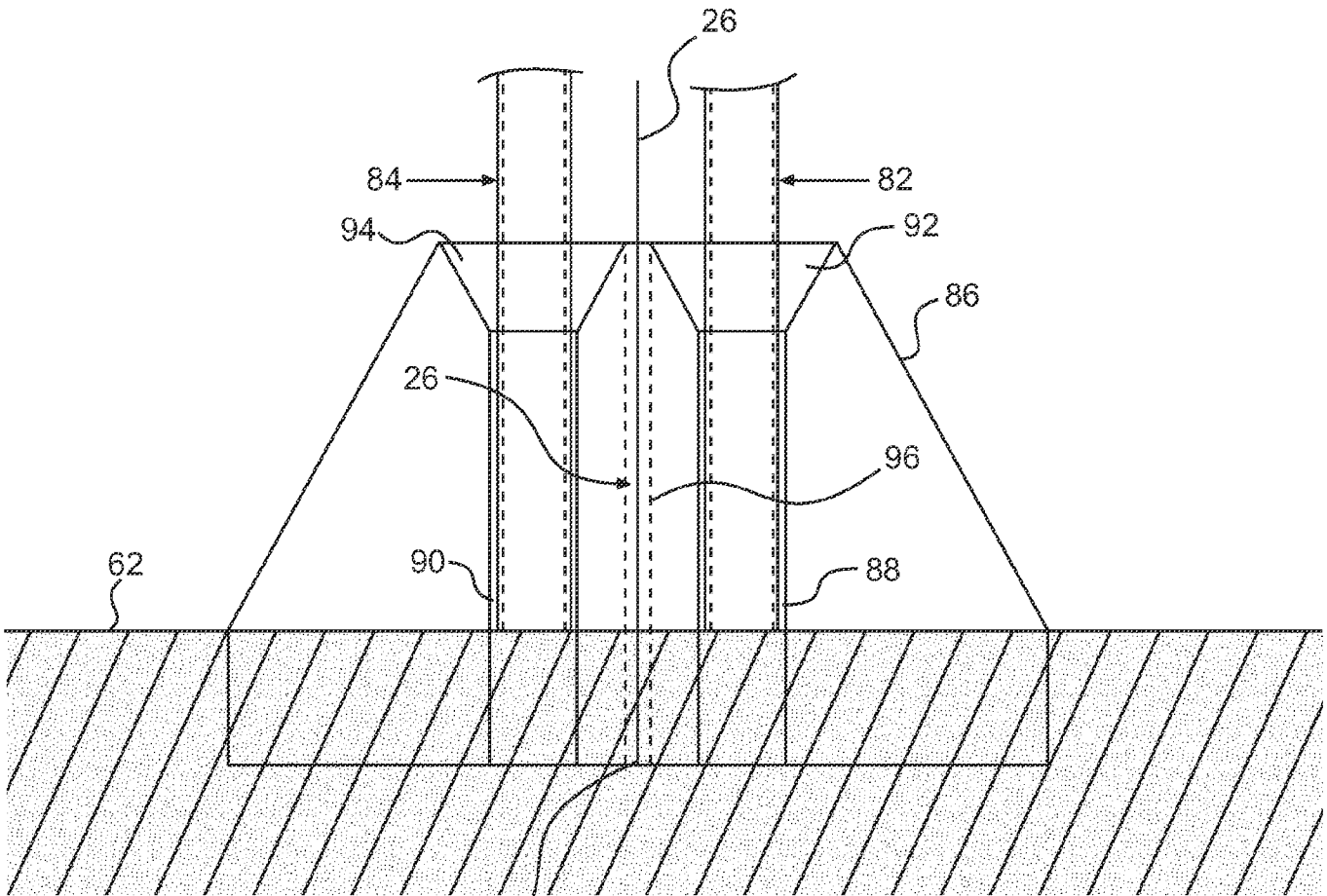
FIG. 7 is a front view of one of the base structures or footings of the gate of the present invention.

FIG. 7 provides an enlarged side view of the base structure 86, illustrating various aspects of the base structure 86. As may be appreciated from FIG. 7, the base structure 86 is anticipated to be buried, at least in part, in the sea floor 62. As may be appreciated, the base structure 86 may sit on the sea floor 62 and not be partially buried in the sea floor 62.

Figure 8:
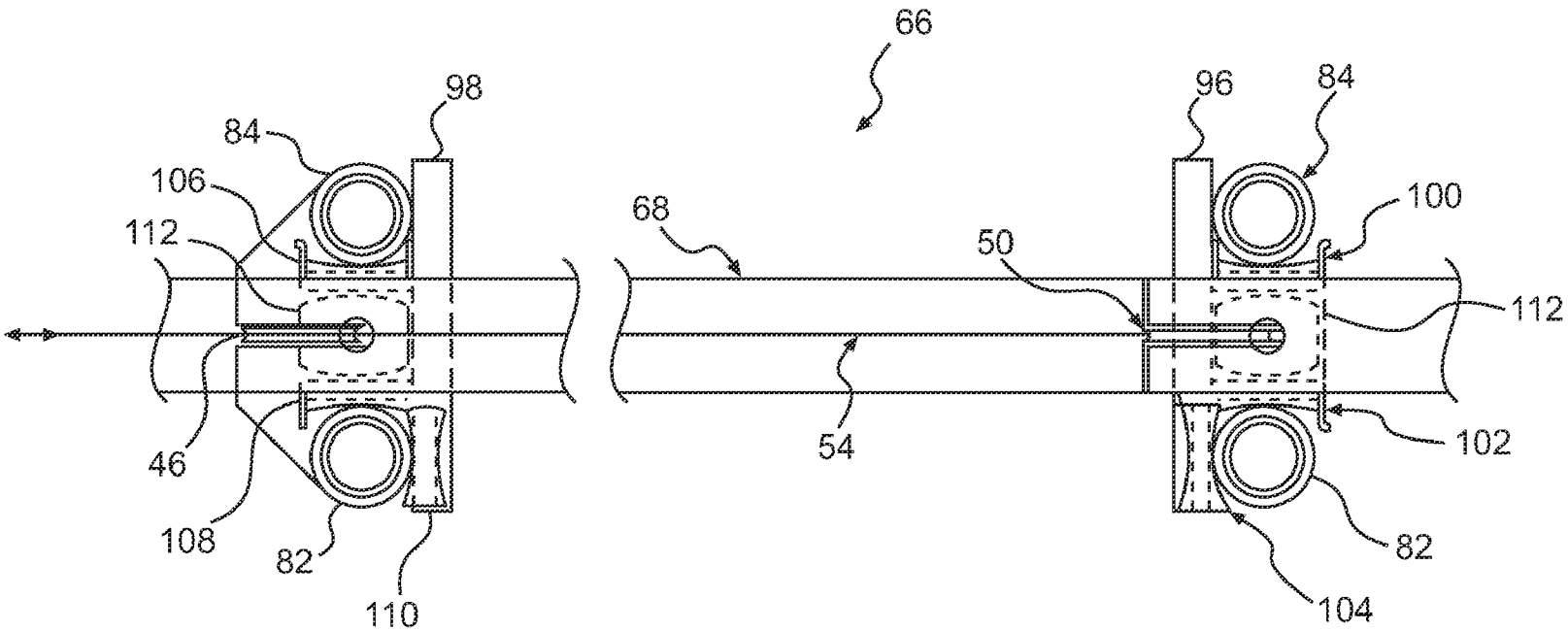
FIG. 8 is a top view of the gate of the present invention.

FIG. 8 is a top view of the marine gate 66 of the present invention. The tubular construction of the first and second posts 82, 84 are apparent in this illustration. Also apparent in this illustration are right and left plates 96, 98, respectively. The plates 96, 98 are affixed to the gate member 68. The plates 96, 98 provide structure to which rollers 100, 102, 104, 106, 108, 110 are affixed. The rollers 100-110 provide a snug fit between the gate member 68 and the guide posts 30. The rollers 100-110 also assure that the gate member 68 travels unimpeded between the open and closed positions.

Figure 9:
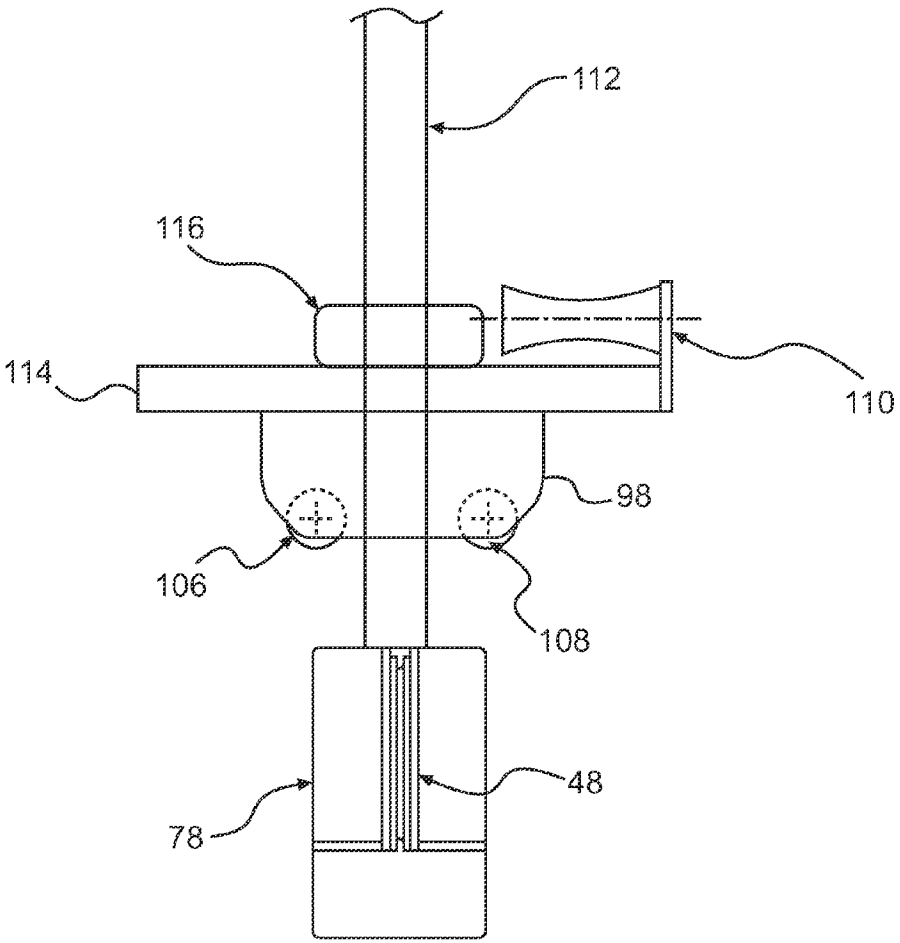
FIG. 9 is a partial side view of the gate of the present invention.

FIG. 9 provides a side view of a portion of the gate member 68 of the present invention, providing details of the connection between the bottom portion and the rollers 106, 108, 110 that are on the left hand side of the gate member 68. As may be appreciated, this discussion applies equally to the right hand side of the gate member 68.

The pulley 48 is positioned within the bottom portion 78 of the gate member 68. A tubular member 112 extends upwardly from the bottom portion 78. The tubular member 112 is positioned so that the cable 54 will extend within the tubular member 112. As a result, the cable 54 will be protected from the elements and also will be protected from tampering. Plates 114 and 116 provide additional support and rigidity to the gate member 68, as should be appreciated from the illustration.

Figure 10:
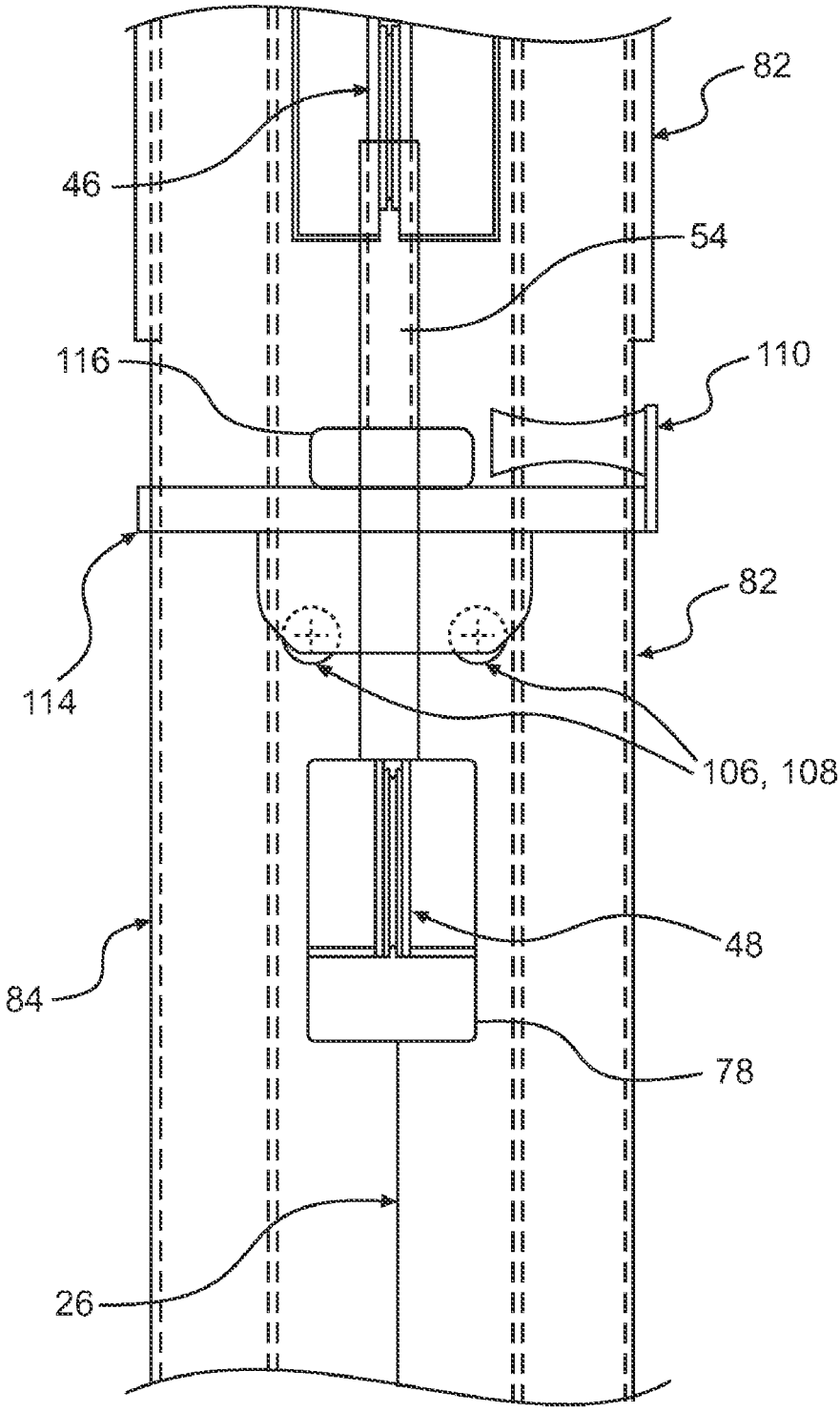
FIG. 10 is an enlarged version of the side view of FIG. 6, with details removed to clarify some of the structure illustrated in FIG. 6.

FIG. 10 is a side view providing a greater level of detail of the construction and cooperation between the various components of the gate member 68.

In the opened position, the gate member 68 is contemplated to move toward the sea floor 62 and remain about 2.0 meters above the sea floor 62. As should be apparent, this dimension is merely exemplary and is not meant to be limiting of the present invention.

In the closed position, it is contemplated that the gate member 68 will be extended so that it is not submerged in the water. This offers a couple of advantages. First, with the gate member 68 out of the water, the water cannot exert forces on the gate member 68 that might cause the gate member 68 to be pushed in one direction or another. Second, since the gate 66 is expected to be closed more than it is opened, there is expected to be a reduced degree of corrosion on the gate member 68. Third, if the gate member 68 sits above the waterline 44, it is more easily identified by vessels 16 intending to enter into or exit from the secure perimeter. Other advantages also are contemplated due to this design.

As indicated by FIG. 11, the optic fiber net 26 is contemplated to be constructed from a single optic fiber wire 114 that is woven in a pattern such that the single optic fiber wire 114 forms the fiber optic net 26. In other words, the optic fiber net 26 contains only one, continuous optic fiber wire 114. This is not to say that the continuous optic fiber wire 114 may not be made up of several individual optic fiber wires 114 connected end to end via a suitable connection, as should be appreciated by those skilled in the art. Moreover, the optic fiber wire 114 may comprise several optic fiber wires that are bundled together.

While the optic fiber net 26 is contemplated to include only one optic fiber wire 114, it is contemplated that the optic fiber net 26 may include multiple (i.e., two or more) optic fiber wires 114 stranded together. Such a construction offers advantages that the single optic fiber wire 114 does not. For example, the optic fiber net 26 may be made stronger when two or more optic fiber wires 114 are stranded together. Alternatively, with the stranded approach, if one optic fiber wire 114 breaks, the optical signal may be switched (manually or automatically) to the remaining optic fiber wire(s) 114 without the immediate need to replace or repair the damaged optic fiber wire 114. Moreover, additional optic fiber wires 114 may be relied upon to provide redundancy in the optic fiber net 26. If one of the optic fiber wires 114 breaks, the optical signal that, is introduced as part of the marine security system may automatically switch its operation to rely on one or more of the optic fiber wires 114 to determine if there is a breach of more than one optic fiber wire 114, which may increase the accuracy of the marine security system and reduce the occurrence of false alarms. In addition, the marine security system may be designed to cycle periodically between the multiple optic fiber wires 114 for added security. Other advantages of the stranded approach will be apparent to those skilled in the art.

Regardless of the specific construction of the optic fiber wire 114, the optic fiber net 26 is contemplated to be fabric that contains at least one continuous, unbroken optic fiber wire 114.

Alternatively, the optic fiber wire 114 may be woven into a plurality of individual panels that may be connected (preferably optically) to one another to form a continuous fiber optic screen from one end of the optic fiber net 26 to the other.

It is contemplated that the optic fiber net 26 may be made from a plurality of panels that are connected to one another in series to be operated in unison. Alternatively, the plurality of individual panels may be operated independently from one another. In other words, the individual panels need not be serially connected to one another for operation of the present invention.

The optic fiber wire 114 is contemplated to include a single optic fiber that is clad in a suitable protective coating. The protective coating may be one or more layers of polyvinyl chloride and/or other materials, including aramid fibers such as Kevlar®, that provide adequate strength for the optic fiber wire 114. The construction of the optic fiber wire 114 should permit the wire 114 to flex. Flexibility of the optic fiber wire 114 is desirable because the optic fiber net 26 will be subject to repeated stresses and strains from the environment and from the marine gate 10, 66 of the present invention.

FIG. 12 illustrates one contemplated arrangement of various components of a security system 116 that may be operated with the optic fiber net 26 that is employed by the present invention. The optic fiber net 26 has an input end 118 and an output end 120. At its input end 118, the optic fiber wire 114 is connected to a light generator 122. The light generator 122 may be a laser or a Class 1 laser diode with an output wavelength of either 850 nm or 1300 nm, among others. The light also may include wavelengths of visible light or of any other portion (or portions) of the electromagnetic spectrum. In one contemplated embodiment, the light falls within the infrared portion of the electromagnetic spectrum. The output end 120 of the optic fiber wire 114 is connected to a light receiver 124. The light receiver 124 may be any type of receiver including a PIN Diode, for example.

The light generator 122 and the light receiver 124 are, in turn connected to a monitoring station 126, which is contemplated to be positioned at remote location. The connection to the monitoring station 126 may be via a wired connection or a wireless connection, as should be appreciated by those skilled in the art. If the connection is wireless, in one embodiment, the transmission of signals may be via any suitable transmission wavelength of electromagnetic radiation including, but not limited to radio waves, microwaves, and infrared light. While not enumerated, other transmission method and means also may be employed without departing from the scope of the present invention.

The security system 116 operates to generate an alarm if there is a break in the optic fiber net 26, as discussed below. It is also possible for the security system 116 to generate an alarm if a strain is placed on the optic fiber net 26 that exceeds a predetermined threshold.

Light emitted by the light generator 118 is introduced into the optic fiber wire as a light input. The light input signal is conducted through the optic fiber wire 114. At the other end of the optic fiber wire 114, a light signal is outputted as an output light signal, which is received by the light receiver 120. During operation, should a person cut through the optic fiber net 26, the light signal conducted by the optic fiber wire 114 will be interrupted. The light receiver 120 will detect the absence of a light output signal. As a result, the monitoring station 126 will respond by generating an alarm signal. The alarm signal may trigger, among other types of alarm indications, a visible and/or an audible alarm.

Even if the optic fiber wire 114 in the optic fiber net 26 is not cut, it is possible that the light passing through the optic fiber wire 114 may be sufficiently degraded to trigger an alarm under certain circumstances.

As may be appreciated, the optic fiber net 26 provides a simple, reliable, and flexible fence that may be deployed around a perimeter to establish a secure zone. The marine gate 10, 66 of the present invention is intended to cooperate with the optic fiber net 26 so that vessels 16 may enter into or exit from the secure perimeter.

It is noted that concepts and features from one embodiment described above may be employed in other embodiments, as should be appreciated by those skilled in the art. Therefore, the discussion of certain features with respect to one embodiment of the present invention should not be considered to be unique or required only for that particular embodiment.

While the marine gate of the present invention has been described in connection with specific embodiments thereof, the present invention is not intended to be limited solely to the embodiments described. As will be appreciated by those skilled in the art, elements of the invention may be altered from the specifics discussed above without departing from the scope and spirit of the invention. Moreover, it is intended that all equivalents that will be appreciated by those skilled in the art also fall within the scope of the present invention as discussed above and as recited by the claims appended hereto.

What is claimed is:

1. A marine gate, comprising:

a gate member submersible in a body of water, wherein the body of water is defined by a sea floor and a waterline;

at least a first post and a second post supporting the gate member, wherein the first and second posts extend from a first location at the sea floor to a second location above the waterline and wherein the gate member is slidably secured on the first and second posts so that the gate member is movable between the first and second locations;

a winch;

a cable extending from the winch to the gate member; and an optic fiber net attached at least to the gate member and extending to the sea floor, thereby establishing an underwater fence;

wherein operation of the winch alters a length of the cable, thereby permitting the gate member to be raised to a closed position and to be lowered to an opened position such that a vessel may pass through the gate when the gate member is in the opened position.

2. The marine gate of claim 1, further comprising:

a first pulley disposed at a location adjacent to a top of the first post;

a second pulley disposed on the gate member adjacent to the first post;

a third pulley disposed on the gate member adjacent to the second post;

wherein the cable extends from the winch, from the first pulley to the second pulley, from the second pulley to the third pulley, and from the third pulley to a fixed location on the second post.

3. The marine gate of claim 1, wherein the first post and the second post each comprise two cylindrical pipes disposed adjacent to one another.

4. The marine gate of claim 1, wherein the gate member includes a plurality of rollers in contact with the first and second posts to facilitate slidable engagement between the gate member and the first and second posts.

5. The marine gate of claim 1, wherein the optic fiber net comprises at least one optic fiber wire woven to form a continuous light channel from a first end to a second end.

6. The marine gate of claim 5, further comprising:

a light generator connected to the first end of the optic fiber net to introduce a light signal thereinto;

a light receiver connected to the second end to receive a light signal exigent from the optic fiber net; and a monitoring station connected at least to the light receiver.

7. The marine gate of claim 6, wherein the monitoring station generates an alarm if the light signal received by the light receiver differs from the light signal introduced into the first end by a predetermined amount.

8. The marine gate of claim 2, wherein the gate member further comprises:

a hollow bottom portion through which the cable travels from the second pulley to the third pulley.

9. The marine gate of claim 8, wherein the gate member further comprises:

two tubular members extending upwardly from the hollow bottom portion, wherein the cable travels through the one of the two tubular members from the first pulley to the second pulley and through the second of the two tubular members from the third pulley to the fixed location on the second post.

10. The marine gate of claim 1, further comprising:

a first base structure; and a second base structure, wherein the first and second base structures are disposed on the sea floor and define channels therein to receive the first post and the second post, respectively.

11. The marine gate of claim 10, wherein the first and second base structures further define conical portions therein to facilitate positioning of the first and second posts therein.

12. The marine gate of claim 1, wherein the winch is electrically powered.

13. The marine gate of claim 1, wherein the winch is powered by a diesel motor.

14. The marine gate of claim 1, wherein the winch is pneumatically operated.

15. The marine gate of claim 10, wherein the optic fiber net extends from the gate member to the first and second base structures.

16. The marine gate of claim 15, wherein the first and second base structures define channels therein to receive bottom edge of the optic fiber net.

17. The marine gate of claim 10, wherein the first and second base structures are at least partially buried in the sea floor.

* * * * *